US005778507A

United States Patent [19]

Grannan et al.

[11] Patent Number: 5,778,507

[45] Date of Patent: Jul. 14, 1998

[54] MACHINE AND METHOD FOR MAKING DOME ARRAYS MOUNTED ON A BACKUP STRIP

[75] Inventors: Dennis A. Grannan; Robert A. Baum, both of Ft. Collins, Colo.; Randall J. Brodka, Mt. Pleasant, Iowa

[73] Assignee: Lucas Automation & Control Engineering, Inc., Hampton, Va.

[21] Appl. No.: 411,430

[22] Filed: Mar. 27, 1995

[51] Int. Cl.[6] ..... B26D 5/22; B65B 63/00

[52] U.S. Cl. ..... 29/412; 29/335; 29/469.5; 29/564.6; 53/427; 53/435; 53/520; 53/553

[58] Field of Search ..... 29/412, 469.5, 29/335, 564.1, 564, 564.6, 417; 206/713, 717; 156/261, 264, 265, 267, 270; 53/450, 553, 435, 427, 133.8, 520, 591

[56] References Cited

U.S. PATENT DOCUMENTS

| | | | |
|---|---|---|---|
| 2,335,292 | 11/1943 | Messenger | 29/412 X |
| 2,789,640 | 4/1957 | Belden | 53/435 |
| 2,965,865 | 12/1960 | Zack | 206/717 X |
| 3,274,665 | 9/1966 | Higginson et al. | 29/564.6 X |
| 3,338,084 | 8/1967 | Stegman, Sr. | 29/412 X |
| 3,477,194 | 11/1969 | Corrsin | 53/450 |
| 3,665,672 | 5/1972 | Speelman | 53/435 |
| 4,062,449 | 12/1977 | Popkes et al. | 53/427 X |
| 4,073,671 | 2/1978 | Licata | 29/469.5 X |
| 4,599,125 | 7/1986 | Buck | 156/267 X |
| 5,036,571 | 8/1991 | Borst et al. | 29/235 |
| 5,055,155 | 10/1991 | Crotty et al. | 156/261 X |
| 5,369,875 | 12/1994 | Utsunomiya et al. | 29/412 X |
| 5,507,910 | 4/1996 | Miyajima | 156/261 X |

OTHER PUBLICATIONS

"Snap Dome Switch Products Designers Guide," Data Entry Products Catalog, pp. 1–9, 2–3, 3–1, and 3–5 (1993).

*Primary Examiner*—Joseph M. Gorski
*Attorney, Agent, or Firm*—Lloyd L. Zickert

[57] ABSTRACT

A machine and method for making a strip of dome arrays on a backup strip, wherein the dome arrays include a plurality of domes in a predetermined non-linear pattern and in oriented relation to each other that are adhesively mounted on a dome seal. The machine comprises a punch press or stamping machine capable of simultaneously stamping a pattern of domes in non-linear arrangement and oriented relative to each other and depositing those domes onto the adhesive side of a dome seal strip. The machine also includes means for feeding dome seals to the stamping machine and also for kiss-cutting the dome seal while on the backup strip to define a plurality of successively arranged dome arrays.

8 Claims, 2 Drawing Sheets

MACHINE AND METHOD FOR MAKING DOME ARRAYS MOUNTED ON A BACKUP STRIP

DESCRIPTION

This invention relates in general to a machine and method for continuously making a strip of dome arrays on a backup strip, wherein the dome arrays include a plurality of non-linearly arranged domes on the adhesive side of a dome seal.

BACKGROUND OF THE INVENTION

Heretofore, it has been known to make dome arrays by manually placing domes on a magnetic fixture in orientation with each other, whereby the fixture establishes the spacing between and orientation of the domes. Reference herein to domes, sometimes called dome switches, is to domes having a convexo-concave shape and a outer periphery that may be circular, circular with a single flat, circular with a plurality of flats, or otherwise shaped. More particularly, the domes referred to herein are metal and stamped from a suitable metal strip and of a type that would require orientation. Further, the dome arrays referred to herein are a generally non-linear arrangement of domes on a dome seal protected by a backup strip or release liner until the dome array is applied to a printed circuit board for use in a keyboard. With respect to the above magnetic fixture following the placement of the domes in orientation on the fixture, an adhesive-coated dome seal is placed in contact with the domes to remove the domes from the fixture.

It has further been known to stamp domes and insert them in oriented fashion into pockets of a tape. In order to maintain their orientation, a cover is placed on the tape and the combination of the cover and tape is wound on a spool or reel that may be later removed for purposes of applying the domes to a keyboard. The cover may be in the form of a releasable liner or strip of plastic that would maintain the domes in place in the pockets. This type of a system is called a pocket-tape system.

Heretofore, it has also been known to make a continuous strip of domes and wind the strip of domes onto a reel or spool, wherein the domes are stamped one at a time by a punch press or stamping machine and directly applied to the adhesive side of a dome seal, and thereafter covered with a backup strip or release liner before being wound on a reel. Additionally, these single domes may be arranged for individual removal from the backup strip by kiss-cutting the dome seal.

With the advent of a demand for greater efficiency and lower cost to make dome arrays having non-linearly arranged and oriented domes on a dome seal, the problem of making such dome array is solved by the present invention.

SUMMARY OF THE INVENTION

The present invention solves the problem of avoiding the use of the magnetized dome fixture systems and the pocket-tape systems to provide a strip of dome arrays where the domes are non-linearly arranged and oriented to one another, and in adhesive mounted relation on a dome seal. The dome arrays may thereafter be removed one at a time from the backup strip and transferred to a keyboard printed circuit board or the like to thereafter function as a switching element for the keyboard.

The machine and method of the present invention comprise a stamping machine or punch press having a set of dies capable of simultaneously stamping a plurality of domes that are non-linearly arranged and in orientation to each other and depositing them directly onto the adhesive side of a dome seal or dome seal strip. The machine includes means for feeding a metal strip to the punch press in increments and also simultaneously feeding at the same speed a dome seal strip for receiving the stamped domes. Prior to feeding the dome seal to the punch press, the dome seal is laminated to a backup strip or release liner. The machine separates the backup strip from the dome seal strip and guides it around the stamping machine. Following application of the patterns of domes to the dome seal strip, the backup strip is realigned with the dome seal strip and laminated or joined to the adhesive side of the dome seal strip. Thereafter, the dome seal strip may be kiss-cut in order to define a dome seal and pattern of domes or dome array that can thereafter be lifted from the backup strip and used as an element in a keyboard assembly.

It is therefore an object of the present invention to provide a new and improved machine for making a strip of dome arrays where the domes may be non-linearly arranged in orientation to each other.

Another object of the present invention is to provide a method for making a strip of dome arrays wherein the dome arrays include a plurality of non-linearly arranged domes in oriented relation to each other, adhesively mounted on a dome seal.

A still further object of the present invention is to provide a strip of dome arrays that includes a backup strip on which dome arrays are adhesively mounted for removal therefrom and which include a plurality of domes in non-linear arrangement and in orientation to each other.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 6:
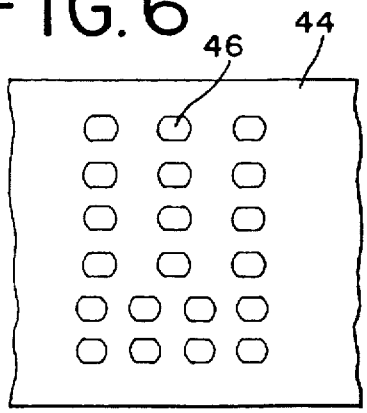
FIG. 6 is a fragmentary view of the dome seal strip onto which a pattern of non-linearly arranged domes in orientation has been placed at the punch press.

The machine of the present invention includes a punch press or stamping machine that is of a well known type with the exception that the punch press includes a special set of dies for simultaneously punching a plurality of domes from a strip of metal and depositing the domes in oriented relation onto a dome seal strip. Thus, a metal strip is incrementally fed to the dies of the stamping machine where the domes stamped will be in non-linear arrangement and oriented to each other. The use of the word "non-linear" in this application in intended to refer to a plurality of domes that are not along a single line. Thus, a plurality of rows or lines of domes, where there may even be a different number of domes in each row, would constitute a non-linear arrangement of domes, such as illustrated in FIG. 6. It will be appreciated that any number of rows with any number of domes in each row to form any sort of predetermined pattern would constitute a predetermined non-linear pattern of domes.

The dome seal strip is fed to the dies of the stamping machine from a composite strip including a dome seal strip that is laminated by a layer of pressure-sensitive adhesive on the dome seal strip to a backup strip wherein the backup strip is separated from the dome seal strip and is guided around the stamping machine. After the domes are deposited onto the dome seal strip, the backup strip is realigned with the dome seal strip and again laminated onto the strip having the domes. Thereafter, the dome seal strip would be kiss-cut to define a dome seal for a plurality of patterned domes that is mounted on a backup strip or carrier, and which may be removed from that carrier in an assembly process where the dome arrays are applied to a printed circuit board or the like for assembly in a keyboard. The strip of dome arrays would be wound onto a reel at the outlet end of the machine.

Figure 1:
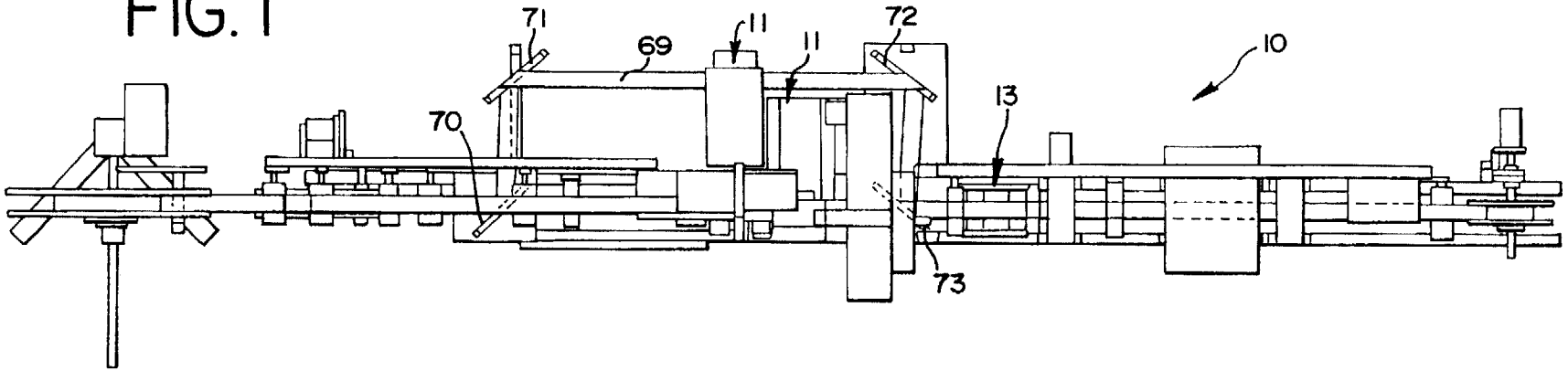
FIG. 1 is a plan view of the machine according to the invention for making a strip of dome arrays.
Figure 2:
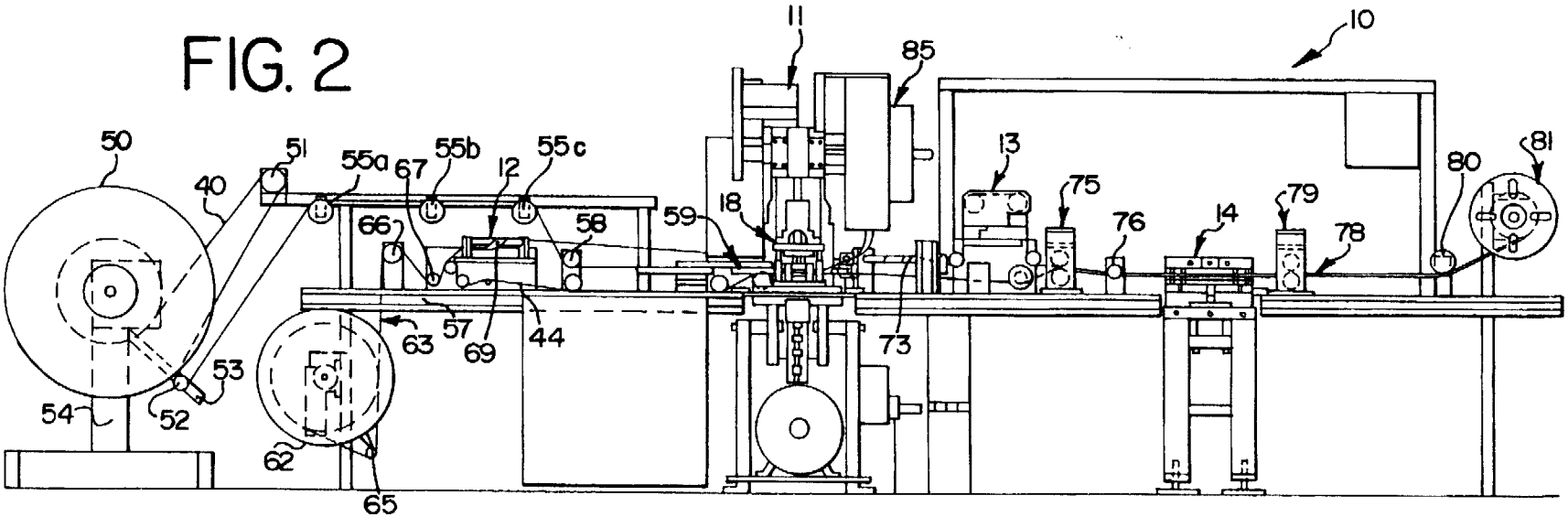
FIG. 2 is a front elevational view of the machine of FIG. 1.

Referring now to the drawings, and particularly to FIGS. 1 and 2, the machine of the invention is generally designated by the numeral 10 and includes a punch press or stamping machine 11, a separator 12 for the dome seal strip and backup strip to separate the backup strip from the dome seal prior to the feeding of the dome seal to the punch press, a realigner 13 for realigning the backup strip to the dome seal strip after the domes have been deposited onto the dome seal strip, and a kiss-cutting device 14 for kiss-cutting the dome seal to define the dome arrays.

Figure 4:
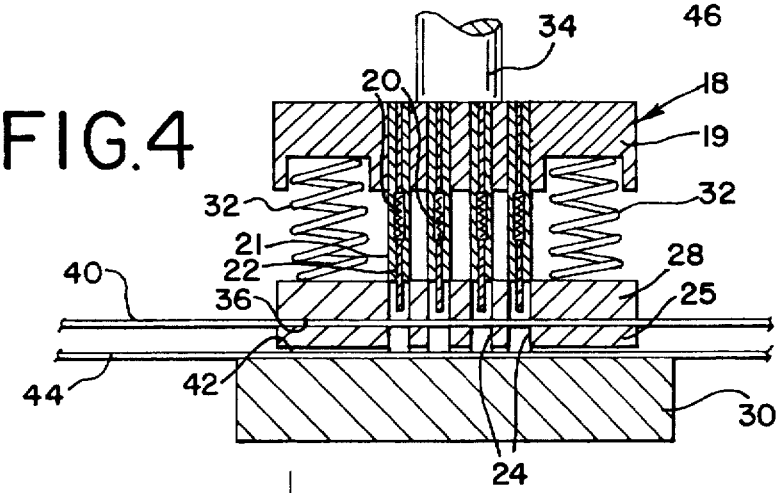
FIG. 4 is a still greater enlarged sectional view taken through the set of dies used for stamping the domes and showing the direct application of the domes onto the dome seal strip and illustrating the ejector punch in raised position prior to stamping of the domes.
Figure 5:
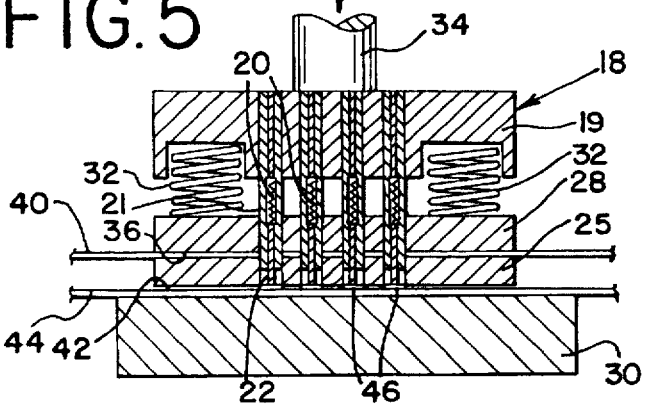
FIG. 5 is a view similar to FIG. 4 except the ejector punch is shown in the down position after it has stamped the domes and ejected them from the die set for deposit on the dome seal strip.

The punch press includes a set of non-linearly arranged dies 18, more particularly illustrated in FIGS. 4 and 5, which include a punch holder 19 having a plurality of punch ejectors 20, including punches 21 and ejectors 22. The punches 21 are formed to mate with the die openings 24 of the die matrix 25, so that when the punch is lowered and driven through the material from which the domes are made. The punches will stamp or cut the domes in coaction with the die openings 24, as well as to form the domes in a convexo-concave shape. A stripper plate 28 is positioned above the die matrix 25 and also provided with punch holes of the same shape as the die openings 24. The stripper mates with the die matrix plate, all of which are held by the die matrix holder 30. Springs 32 are provided between the punch holder 19 and the combination die matrix plate, die matrix stripper assembly to assist in the return stroke of the punch holder following a punching operation. The head of the punch press is suitably connected to the die holder through the shaft 34. A gap or slot 36 is provided between the stripper and the die matrix and through which the metal strip 40 is incrementally fed during the stamping operation. A second slot or gap 42 is provided between the die matrix and the die matrix holder through which the dome seal or dome seal strip 44 having a layer or coating of pressure-sensitive adhesive on one side is incrementally fed at the same speed as the metal strip 40.

In operation of the punch press, a downward stroke of the punch holder drives the punches through the metal strip at a time when the strip is stationary to not only cut but form the domes and drive them into the die openings 24, after which they will be ejected from the die openings by the ejectors 22 and discharged onto the dome seal 44.

It will be appreciated that the dome seal will normally be of a suitable polyester having a pressure-sensitive adhesive coating on one side and the side of the adhesive coating will be facing the domes as they are punched at the punch press, so that they are applied directly to the dome seal. For example, Mylar (a trademark of DuPont) polyester film can be used. Thereafter, the punches will retract to the home position, as illustrated in FIG. 4, and the dome seal would be advanced to take the pattern of domes on the seal away from the punch press for subsequent processing in the machine. Similarly, the metal strip would advance to bring a fresh or unstamped part of the metal strip to the dies for cutting a successive set of domes. FIG. 6 illustrates a pattern of domes 46 that are deposited onto the adhesive side of the dome seal 44 following the dome punching operation.

The metal strip for the punch press is supplied from the metal strip reel 50. The strip comes off the reel and is trained over an upper roller 51 and then back downwardly over a tension roller 52 on a gravitationally pivotally mounted tension bar 53. The reel 50 is suitably supported for rotation on a stand 54. From the tension roller 52, the metal tape is guided upwardly across three guide rollers **55*a*, 55*b* and 55*c* mounted in spaced-apart relation on a support 56 that is supported above the main frame support 57 of the machine. From the roller 55*c*, the metal strip is trained downwardly and under a guide roller 58 to a punch press feed 59**.

The punch press feed is of a standard type such as the Type 2 model made by Rapid Air Corporation of Rockford, Ill. Any suitable type of feed may be provided which is capable of incrementally feeding the metal strip to the punch press. While the details of this feeder are not shown, it will be appreciated that it operates by gripping the metal strip, advancing it a suitable increment, and then dwelling during the time the punch press operates to punch the domes. Thereafter, the feed will loosen the grip on the metal strip and return to home position to regrip the metal strip and successively feed increments of the metal strip to the punch press in synchronism with the operation of the punch press.

The dome seal strip 44 is supplied to the punch press from a reel 62 having wound thereon a composite dome seal strip and backup strip designated by the numeral 63. The separator 12, into which the composite backup strip and dome seal strip 63 is guided, serves to separate the backup strip from the dome seal strip. This composite member 63 is trained over a tension roller 65 to maintain the composite member taut at all times in a similar fashion that the tension roller 52 maintains the metal strip 40 taut at all times. The composite member 63 is then guided upwardly over a guide roller 66 and then downwardly over a guide roller 67 and into the separator 12. The backup strip of the composite member 63 is designated by the numeral 69 and is trained over a series of rollers around the punch press 11 and back to the main line of the machine to be rejoined with the dome seal after domes have been deposited on the dome seal.

As seen particularly in FIG. 1, the backup strip 69 is guided rearwardly over an initial roller 70 at the separator to a roller 71 supported rearwardly of the main line of the machine and then parallel to the main line to a return roller 72 and back to the main line of the machine by roller 73, so that the same side of the backup strip will again come in contact with the dome seal strip. After the backup strip leaves the line roller 73, it is received by the realigner 13 that serves to realign the backup strip to the dome seal strip so that the edges of the strips are co-extensive. It will be appreciated that a standard off-the-shelf realigning device would be employed, such as the one sold by North American Manufacturing Co. of Cleveland, Ohio, and marketed as an Accu Trac® Electro-Mechanical Guiding System.

As the backup strip and dome seal strip with the domes thereon leave the realigner, they are received by the pinch roller assembly 75 and relaminated at the guide roller 76. From the guide roller 76, the combination backup strip, dome seal strip and domes are processed at the kiss-cutting device 14 whereby the dome seal is kiss-cut to define the dome seal for a dome array that can thereafter be separated from the backup strip for assembly in a keyboard. After leaving the kiss-cut device, the product designated by the numeral 78, and being in the form of a plurality of dome arrays carried on a backup strip, is directed through a pinch roller assembly 79 and under a guide roller 80 to be wound onto a product reel 81.

Figure 3:
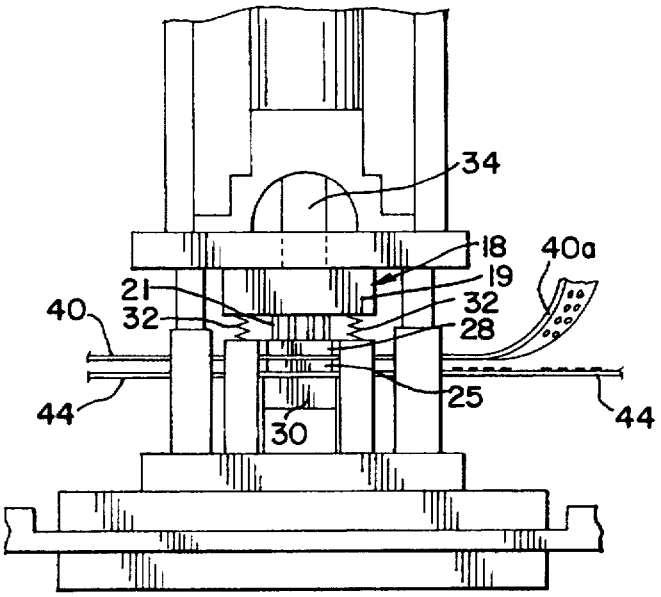
FIG. 3 is a greatly enlarged and fragmentary front elevational view of the stamping machine illustrating the feeding of the metal strip from which domes are stamped and the feeding of a dome seal strip onto which the domes are deposited after they are stamped.

As seen most clearly in FIGS. 2 and 3, the punched metal strip 40*a* is salvaged by winding it on a salvage reel 85 so that the metal can be suitably recycled.

Figure 7:
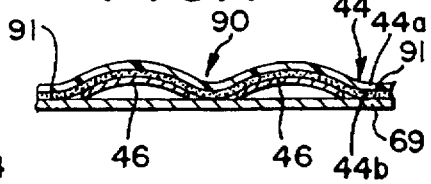
FIG. 7 is a cross-sectional view taken through the strip of dome arrays according to the invention.

From the foregoing, it will be appreciated that the machine 10 of the invention economically and efficiently is capable of making dome arrays on a backup strip where the domes are non-linearly arranged and in oriented relation to each other so that the array can be removed from the backup strip and directly assembled in a keyboard. As particularly seen in FIG. 6, the domes 46 are circular with opposing flat sides and the domes are oriented with respect to each other such that they can go directly onto a printed circuit board as they will be held in place by the adhesive coating on the dome seal. An array is illustrated generally in FIG. 7 by the numeral 90 wherein it is seen that the dome seal has been kiss-cut at 91 so that it can be removed from the backup strip 69. Also illustrated in FIG. 7 is the dome seal 44 having a polyester layer 44*a* and a pressure-sensitive adhesive layer 44*b*. The non-linearly arranged domes in a pattern is illustrated in FIG. 6 as well as the orientation of each dome to each other.

It will be understood that modifications and variations may be effected without departing from the scope of the novel concepts of the present invention, but it is understood that this application is to be limited only by the scope of the appended claims.

The invention is hereby claimed as follows:

1. A machine for continuously making a strip of dome arrays on a backup strip therefor wherein each array includes a plurality of domes mounted on a dome seal in a predetermined non-linear pattern and in oriented relation, said machine comprising:

means for simultaneously stamping a plurality of domes in a predetermined non-linear pattern and in oriented relation from a metal strip including a set of dies for stamping a plurality of domes from the metal strip in a predetermined non-linear pattern and in oriented relation, said set of dies having a discharge end from which the domes are discharged in oriented relation following the stamping thereof, means for incrementally feeding said metal strip to the input end of said stamping means, means for incrementally feeding a dome seal strip having an adhesive coating on one side and a backup strip releasably laminated thereto toward the input end of the stamping means in synchronism with said metal strip feeding means, means ahead of the input end of the stamping means for separating the dome seal strip from the backup strip, means feeding the dome seal strip through the stamping means and along the discharge end of said set of dies with the side having the adhesive coating facing said discharge end of the dies so that the domes are deposited on the adhesive coating side of said dome seal strip in oriented relation, means for routing the separated backup strip around the stamping means, means at the output end of the stamping means for realigning the separated backup strip to the dome seal strip with domes to releasably laminate the backup strip to the dome seal strip, and means synchronized with the metal strip feeding means and the dome seal strip feeding means for kiss-cutting the dome seal strip to define successively spaced apart dome arrays removably carried on the backup strip.

2. The machine of claim 1, which further includes means for winding the dome seal strip, dome arrays and backup strip onto reels.

3. The machine of claim 1, wherein said means for feeding the metal strip includes a reel from which the strip is unwound and tensioning means for maintaining the strip under tension ahead of the stamping means.

4. The machine of claim 1, wherein said means for feeding the laminated dome seal strip and backup strip includes a reel from which the strip is unwound and tensioning means for maintaining the strip under tension ahead of the stamping means.

5. The machine of claim 1, wherein the stamping means includes a punch press.

6. The machine of claim 2, which further includes means between the realigning means and the kiss-cutting means for laminating the backup strip to the dome seal strip having the domes.

7. A method of continuously making a strip of dome arrays on a backup strip, whereby each dome array includes a plurality of non-linearly arranged domes on the adhesive side of a dome seal strip, comprising the steps of:

providing a metal strip;

providing a composite strip having a backup strip and a dome seal strip joined by a pressure-sensitive adhesive on said dome seal strip;

providing a punch press having a set of dies that are arranged in a non-linear pattern with respect to one another to stamp a plurality of domes in a non-linear pattern;

feeding said metal strip and said composite strip towards said punch press;

separating said backup strip from the pressure-sensitive adhesive on said dome seal strip upstream of said punch press and conveying said backup strip around said punch press;

incrementally conveying said metal strip and said dome seal strip in substantially parallel spaced relation and at the same speed through said punch press with said pressure-sensitive adhesive facing said metal strip;

operating said punch press while incrementally conveying said metal strip and said dome seal strip therethrough, thereby causing each of said dies to stamp a dome from said metal strip and deposit said dome onto said pressure-sensitive adhesive such that said dome seal strip receives a non-linear array of domes in a non-linear pattern;

conveying said dome seal strip carrying said non-linear pattern of domes from said punch press;

applying said backup strip to said dome seal strip downstream of said punch press such that said pressure-sensitive adhesive joins said backup strip to said dome seal strip and said backup strip covers said non-linear pattern of domes; and kiss-cutting said dome seal strip such that each dome array may be individually removed from said backup strip.

8. The method of claim 7, wherein the step of applying the backup strip includes the step of aligning the backup strip to the dome seal strip carrying said non-linear pattern of domes.

* * * * *